United States Patent [19]

Nardozzi, Jr.

[11] 4,063,517

[45] Dec. 20, 1977

[54] RAPID TRANSIT SYSTEM

[76] Inventor: Michael A. Nardozzi, Jr., 255 Richland Drive, Pittsburgh, Pa. 15235

[21] Appl. No.: 623,494

[22] Filed: Oct. 17, 1975

[51] Int. Cl.[2] ..... B60S 13/02; A63G 3/00; A63G 21/18

[52] U.S. Cl. ..... 104/35; 104/58; 104/73; 104/134

[58] Field of Search ..... 104/134, 58, 59, 73, 104/69, 70, 72, 138 R, 139, 136 G, 35

[56] References Cited

U.S. PATENT DOCUMENTS

| | | | |
|---|---|---|---|
| 566,182 | 8/1896 | Jackman | 104/70 |
| 1,159,519 | 11/1915 | Menier | 104/73 |
| 1,446,440 | 2/1923 | Abt | 104/35 |
| 1,601,483 | 9/1926 | Vaszin | 104/70 |
| 3,404,635 | 10/1968 | Bacon et al. | 104/73 |
| 3,498,234 | 3/1970 | Roumejon | 104/134 |
| 3,830,161 | 8/1974 | Bacon | 104/70 |
| 3,837,285 | 9/1974 | Goering | 104/138 R |
| 3,853,067 | 12/1974 | Bacon | 104/70 |

FOREIGN PATENT DOCUMENTS

| | | | |
|---|---|---|---|
| 353,571 | 9/1905 | France | 104/73 |

*Primary Examiner*—Robert J. Spar
*Assistant Examiner*—Carl Rowold
*Attorney, Agent, or Firm*—Stanley J. Price, Jr.; John M. Adams

[57] ABSTRACT

An endless water way is supported by a superstructure and includes a bottom wall and side walls extending upwardly from the bottom wall to form a trough. A pump system effects continuous forward flow of water through the trough of the waterway. A guide track is supported on the waterway above the trough. A plurality of vehicles for transporting passengers from station to station are buoyantly supported by the guide track in the waterway. The guide track maintains the vehicles at a selected depth in the waterway. Each vehicle is provided with braking apparatus for frictionally engaging the guide track of the waterway to slow and stop the vehicles. The continuous forward movement of water in the waterway forwardly propels the vehicles from station to station. A plurality of endless waterways form continuous loops that radiates outwardly from the main terminal to provide transportation around the loops to and from the main terminal. A shunting track is provided at each station for diverting the movement of the vehicles from the waterway to permit the vehicles to bypass the station or insertion and removal of the vehicles from the waterway. Conveyor devices transport the vehicles through the station at a controlled rate of speed to facilitate the boarding and departure of passengers to and from the vehicles.

8 Claims, 22 Drawing Figures

RAPID TRANSIT SYSTEM

BACKGROUND OF THE INVENTION

1. Field of the Invention

This invention relates to a mass transit system and more particularly to a system of transporting vehicles by the continuous forward movement of water in an endless waterway.

2. Description of the Prior Art

Modern mass transit systems are well known in the art and are characterized by the automatic or attended operation of vehicles either singly or in multiple vehicle trains on an exclusive roadway in the form of a continuous loop having stations for passenger boarding and departure located at selected points in the loop. The roadway may comprise either single or double track sections elevated or located at grade. The track sections may be supported by steel guide beams on concrete slabs for steering the vehicle on the roadway. The vehicles or multi-vehicle trains may be propelled by power rails or inductive wires feeding electric current to the electric motors of the vehicles. The transit system generally includes a guidance system which serves to maintain stability of the vehicles as they move from station to station on the exclusive roadway in the continuous loop.

Fully automated transit systems such as the rapid transit system built by the San Francisco Bay Area Rapid Transit District and the Experimental Transit Expressway erected by Westinghouse Company in Allegheny County, Pennsylvania, operate vehicles singly or in multiple-vehicle trains at preselected intervals unidirectionally over an exclusive roadway. The rubber tired vehicles ride on concrete track slabs and are steered through vehicle guidance systems that follow a steel guide beam centered down the track of the roadway. Vehicle current collectors pick up power from energized rails located adjacent the track slab. Intelligence is conveyed to and from the vehicles via conductor wire laid along the inside of the track slab. Thus with this arrangment the operation of the entire system is monitored and controlled remotely from a control center through electrical equipment located at the respective stations along the roadway and aboard the vehicles. A builtin system of checks and interlocks operates to continuously monitor the system operation to detect malfunctions or failures in equipment. In the event of a malfunction or failure in equipment all the vehicles are brought to a halt by an emergency stop procedure. Nevertheless, in the event a vehicle becomes disabled on the roadway it is necessary to place operators on board to recover the vehicle.

Rapid transit systems that utilize the conveyance of vehicles in a waterway by the continuous movement of water therethrough is illustrated and described in U.S. Pat. Nos. 3,404,635; 3,807,806, and 3,854,415. The systems generally comprise an endless waterway in which a plurality of floating vessels are guided and propelled by the forward movement of water in the waterway. Suitable lifting conveyors transport the vehicles up inclines portions of the waterway.

The waterway disclosed in U.S. Pat. No. 3,807,806 utilizes stopper boards that are hingedly connected to the floor of the waterway to effect stopping of the vehicles in the waterway. Nozzles discharge fluid directed at the stopper boards and lift them into vertical position to stop the boat. Electromagnetic valves control supply fluid to the nozzles.

There is need for the mass transportation of passengers by vehicles that operate over an exclusive roadway in the form of a continuous loop. While it has been suggested to provide elaborate fully automated mass transit systems, the safeguards required for such a system render the system commercially unfeasible. Thus a mass transit system is needed that satisfies the problems presented by modern urban-suburban commutation in a safe and efficient manner but economically feasible.

SUMMARY OF THE INVENTION

In accordance with the present invention there is provided a rapid transit system that includes a superstructure and an endless waterway supported by the superstructure. The endless waterway has a bottom wall and sidewalls extending upwardly from the bottom wall to define a trough for the continuous forward flow of water therethrough. A plurality of vehicles for transporting passengers are bouyantly supported in the waterway. A stabilizing mechanism supported by the waterway maintains the vehicles at a selected depth in the waterway to provide continuous forward movement of the vehicles therein. A braking mechanism is provided on each vehicle and is operable to slow and stop the vehicle in the waterway. A pumping system for the rapid transit system generates continuous forward movement of the water in the waterway to forwardly propel the vehicle from station to station on the waterway.

The waterway includes a plurality of endless transit loops that radiate outwardly from a main terminal in selected directions for transporting the vehicle between selected points in each of the transit loops and the main terminal. At the main terminal the vehicle is rotated on the waterway by a pivotal device to change the direction of the vehicles so that the vehicles may complete another circuit of the transit loop. A bumper surrounds each vehicle and is positioned within recesses of the guide track that extend horizontally above the waterway sidewalls. With this arrangement the vehicles are buoyantly supported in the waterway and maintained at a selected height therein for continuous forward movement in the waterway.

An enclosure surrounds the upper portion of the waterway to completely enclose the vehicles in the waterway for protection against severe weather conditions and entrance of obstructions in the waterway. Each of the vehicles is provided with a braking mechanism that includes a brake shoe pivotally connected at one end portion to the bumper of the vehicle, and the other end portion of the brake shoe is connected to an actuator. The actuator is operable to pivot the brake shoe outwardly from the bumper to frictionally engage the guide track. In this manner the forward movement of the vehicle in the waterway is slowed and the vehicle may be eventually brought to a halt.

At each station powered endless conveyors engage the bumper of the vehicle to control the movement of the vehicles through the station to facilitate passenger boarding and departure. Each of the conveyors include a plurality of rollers that rotate an endless belt at a preselected speed. As the vehicles approach a station, the bumper engages the endless belt. Rotation of the endless belt then controls the movement of the vehicle through the station to permit boarding and departure of passengers. Conventional water pumps are located at the stations for maintaining continuous forward movement of water in the waterway to effect the forward movement of the vehicles. Each section of the waterway at a station is provided with a guideway that is positioned on the bottom of the waterway. Guidewheels on each vehicle engage the guideway to further stabilize the vehicle in the waterway as it passes through the station.

A shunting track may be provided at each station for diverting the flow of vehicles from the waterway as it passes through the station. The shunting track has entrances and exits connecting it with the waterway. Control gates pivotally secured to the waterway guide track are moved between open and closed positions to divert the vehicles on the waterway from the waterway onto the shunting track through the station and back onto the shunting track. In this manner the vehicles may by-pass a station without requiring slowing or stopping of the vehicles. In addition, the shunting track facilitates insertion and removal of vehicles from the main waterway.

Accordingly the principal object of the present invention is to provide a rapid transit system that includes an endless waterway through which continuous forward movement of water is generated to effect forward motion of vehicles for the transportation of passengers between selected points on the endless waterway.

Another object of the present invention is to provide a rapid transit system that includes a plurality of vehicles buoyantly supported in a waterway and movable thereon in a controlled manner to provide rapid transportation between stations located at preselected points in a transit loop. A further object of the present invention is to provide a rapid transit system that is economically feasible and efficiently operated to move passengers between selected points by propulsion of vehicles in a waterway.

Another object of the present invention is to provide public mass transportation by vehicles that are moved from station to station on an elevated waterway in which the vehicles are provided with braking mechanisms that permit efficient control of the speed of the vehicle in the waterway.

These and other objects of this invention will be more completely disclosed and described in the following specification, the accompanying drawings and the appended claims.

DESCRIPTION OF THE PREFERRED EMBODIMENTS

Figure 1:
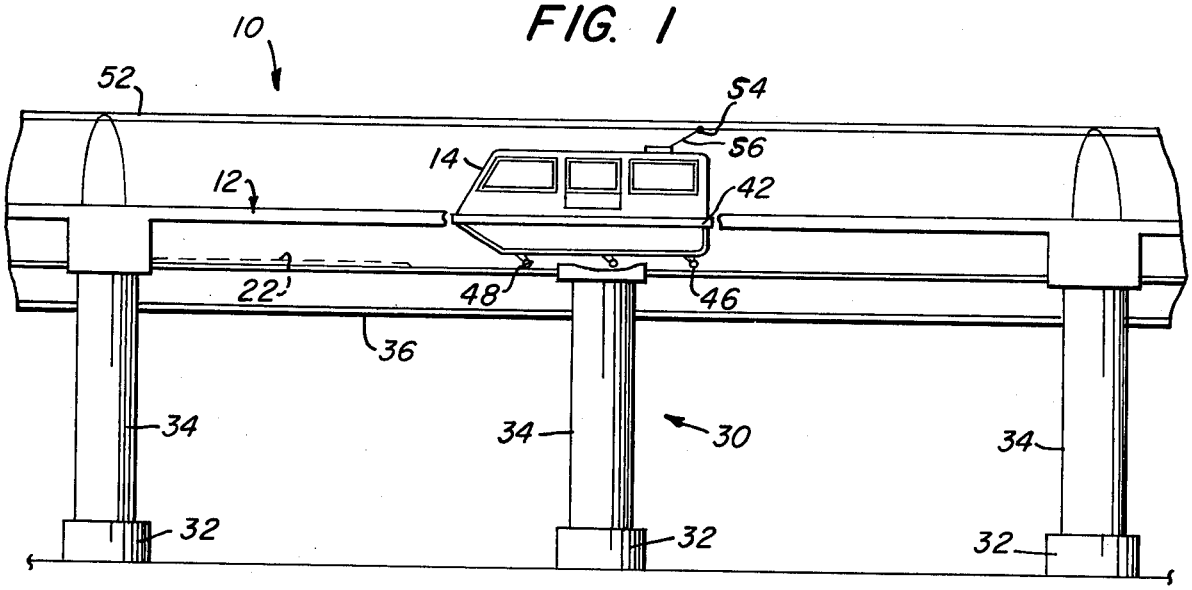
FIG. 1 is a view in side elevation of the transit system, illustrating a single vehicle on the elevated enclosed waterway.
Figure 2:
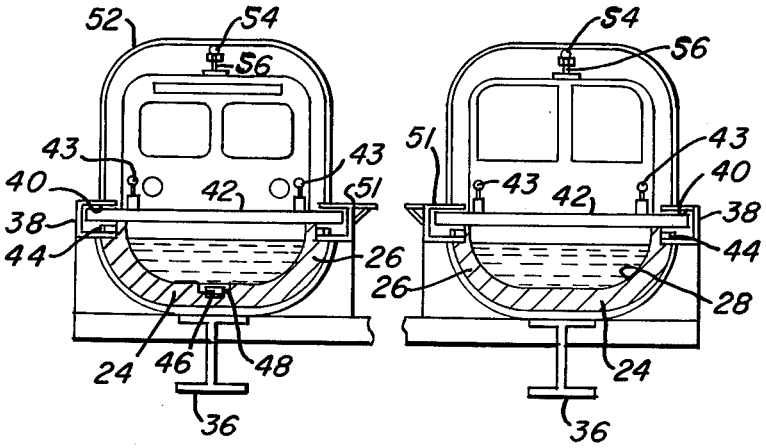
FIG. 2 is a fragmentary view partially in section of the waterway, illustrating the front end of one vehicle and the rear end of another vehicle with the vehicles traveling in parallel relation in opposite directions on the waterway.
Figure 3:
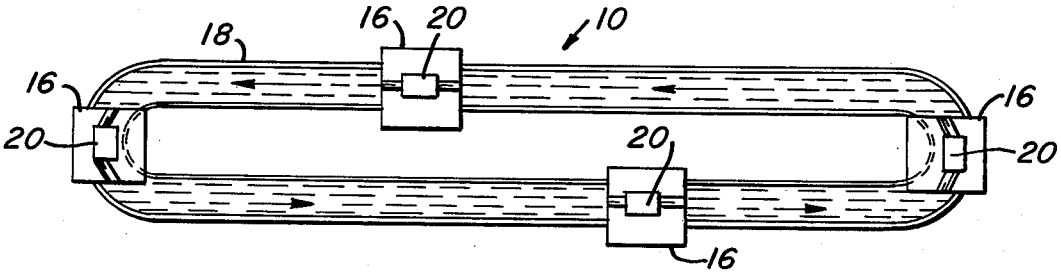
FIG. 3 is a top plan view of an endless loop of the transit system, illustrating the location of stations for the boarding and departing of passengers in the transit loop.

Referring to the drawings and more particularly to FIGS. 1–3, there is illustrated a rapid transit system generally designated by the numeral 10 for the movement of passengers between designated points of travel. The transit system 10 includes an exclusive right-of-way represented by a waterway 12 in which the continuous forward movement of water propels vehicles, such as the vehicle 14 to and from stations or terminals 16 located at designated points in a transit loop 18 formed by the waterway. In the transit loop 18, illustrated in FIG. 3, a continuous fluid movement in the direction indicated by the arrows is obtained by a conventional hydraulic system comprising water pumps 20 located at each individual station 16. In this manner continuous forward movement of the vehicles 14 is accomplished by circulation of water in the waterway 12 by operation of the pumps 20. A unidirectional flow moves the vehicles 14 from station to station in the endless loop 18 of the transit system 10 illustrated in FIG. 3.

The transit system 10 may be in the form of a continuous loop 18 that includes double waterway sections separated from one another as illustrated in FIG. 2. The vehicles 14 are bouyantly supported in the separated waterways 12 that each include a bottom wall 24. A pair of sidewalls 26 curve upwardly from the bottom wall 24 to form a trough 28 through which continuous forward flow of water is generated. The waterway 12 may be located at grade or elevated as illustrated in FIG. 1. The elevated waterways 12 of the double waterway transit system illustrated in FIG. 2 are supported by a steel superstructure generally designated by the numeral 30. The steel superstructure 30 includes a plurality of pedestals anchored in the ground and a rectangular steel column 34 supported and secured to each of the pedestals 32. The columns 34, in turn, support a steel guide beam 36. The bottom wall 24 of the waterway 12 is secured to and positioned on the upper surface of the guide beam 36.

A horizontal guide track 38 is positioned on the upper surface of the waterway sidewalls 26 and includes parallel recesses 40 positioned at a preselected height above the bottom wall 24. A circumferential bumper 42 extends around the body portion of each of the vehicles 14 and is connected thereto by shock absorbers 43. The bumper 42 is positioned within the track recesses 40 and rests upon rollers 44 supported by the track 38. With this arrangement the vehicles are stabilized in the waterway 12 and are located therein at a preselected depth to bouyantly support the vehicles 14 within the waterway 12 for a continuous forward movement by the flow of water in the waterway 12. In another embodiment the rollers 44 may be secured to the bottom surface of the bumper 42 for rotation on the lower horizontal surface of track 38. In this manner the vehicles are stabilized for passenger boarding and departure at the station.

Guideways 22 of the waterway 12, as illustrated in FIG. 1, are secured to the bottom wall 24 for receiving the guidewheels 46 that are secured by struts 48 to the lower surface of the vehicle 14. The guideways 22 are positioned on those sections of the waterway that pass through stations and are located on grades. The guidewheels 46 travel on the guideway 22 to maintain a center position of the vehicle 14 in the waterway 12. This arrangement also exerts an upward lifting force upon the hull of the vehicles 14 which when combined with the buoyancy of the vehicles 14 within the waterway 12 substantially reduces any frictional contact between the hull of the vehicles 14 and the sidewalls 26 so that little or no frictional forces are exerted upon the hull of the vehicles 14 to retard the forward movement of the vehicle in the waterway 12.

A braking mechanism generally designated by the numeral 50 is provided on each of the vehicles 14 to effect stopping of the vehicles in the waterway 12. The braking mechanism 50 is actuated to bring the vehicles to a stop within the waterway 12 by the engagement of a pivotal section of bumper 42 with the guide track 38. With a stopped vehicle stabilized by the bumper 42 within the track 38 passengers may depart or board the vehicles 14 from a platform 51 positioned adjacent the waterway. An enclosure 52 extends upwardly from the track 38 and has curved side portions that conform to the configuration of the vehicle 14. The enclosure 52 may be fabricated from a suitable transparent material such as plexiglass. The enclosure 52 functions to enclose the waterway 12 to prevent obstructions from entering the waterway 12 and provide temperature control within the waterway 12. Electrical power is supplied to the vehicles 14 for the purpose of opening and closing doors, providing light, air conditioning and operation of other auxiliary electrical equipment by an inductive wire 54 secured to the upper inner surface of the enclosure 52 and extending the length of the waterway 12. A suitable electrical connection 56 provided on each vehicle 14 remains in contact with the inductive wire to provide current flow from the inductive wire to the electrical equipment in the vehicle.

Figure 5:
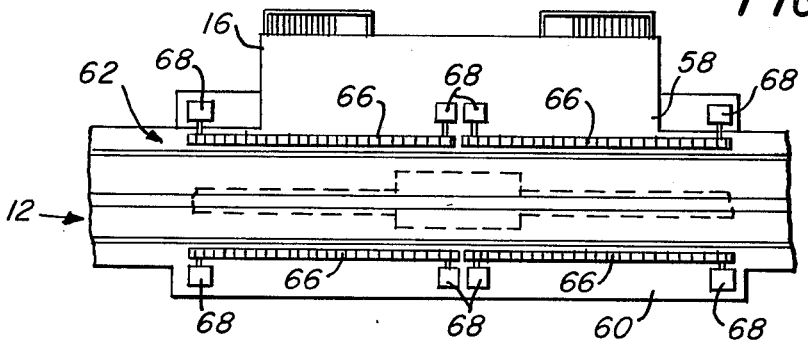
FIG. 5 is a top plan view of FIG. 4, illustrating the powered conveyor for controlling the movement of vehicles approaching and departing the station.

Referring to FIGS. 3 and 5 there are schematically illustrated stations 16 where passengers board and depart the vehicles 14 for transportation between selected stations in the transit system 10 formed by the continuous transit loop 18. The waterway 12 passes through the stations 16 and each includes platforms 58 and 60 located adjacent each side of the waterway 12. A powered endless conveyor mechanism generally designated by the numeral 62 and illustrated in FIGS. 4–7 controls the movement of the vehicles through the station 16. The powered endless conveyor 62 includes a plurality of rollers 64 that are rotatably mounted adjacent to and outboard of the waterway 12 at the sidewalls 26. The rollers 64 are spaced at intervals at the station and extend a preselected distance in opposite directions from the station. An endless belt 66 is reeved around the rollers 64 and includes cleats 67 the project into recesses 69 of bumper 42. A suitable drive mechanism 68 is provided for rotating certain of the rollers 64 in a preselected direction to, in turn, revolve the endless belt 66 engaged to the bumper 42 to propel the vehicle 14 and prevent it from slipping on the conveyor 62.

Figure 4:
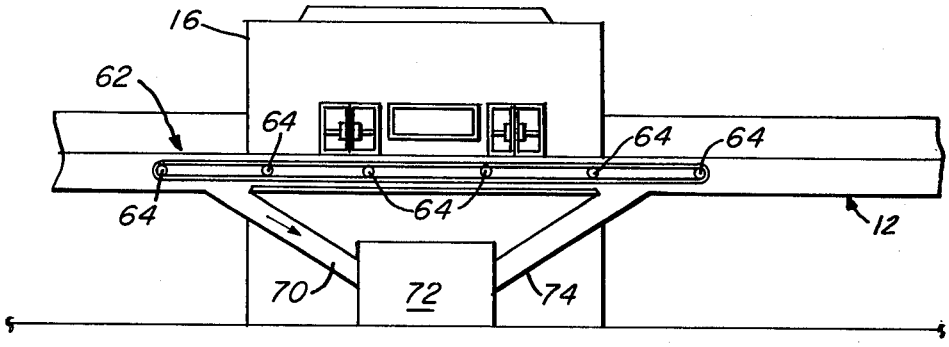
FIG. 4 is a view in side elevation of a station in the transit loop, illustrating a powered conveyor for controlling vehicle movement through a station and the pumping arrangement for circulating water to and from the waterway at the station.

As illustrated in FIG. 4 a portion of the flow of water through the waterway 12 is diverted therefrom through a conduit 70 to the pump 72. The pump 72 displaces the water through conduit 74 back into the waterway 12. With this arrangement the flow of water through the station 16 is substantially reduced to subsequently reduce the rate of forward motion of the vehicles through the station 16. Operation of the powered endless conveyor 62 functions to direct the vehicles 14 through the station 16 at a controlled speed as required by the reduced flow of water through the station 16.

Figure 6:
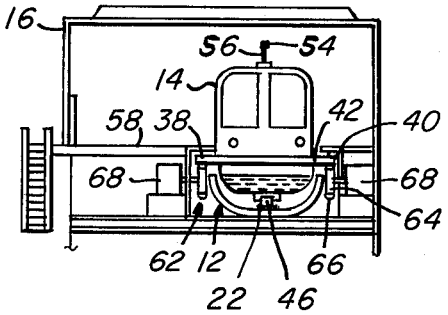
FIG. 6 is a front view of a vehicle positioned in the waterway, illustrating the powered conveyor for stabilizing the vehicle when stopped at the platform of the station for the boarding and departure of passengers.
Figure 7:
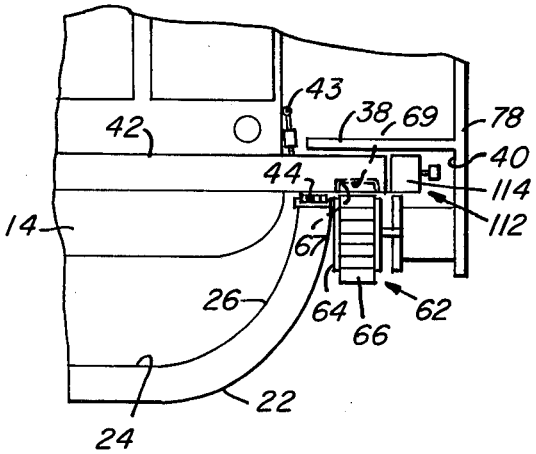
FIG. 7 is an enlarged fragmentary view of a vehicle, illustrating braking apparatus secured to the guide track for stopping the vehicle in the waterway.

As the vehicles 14 approach the station 16, the bumper 42 of the vehicles engages the upper surface of the endless belt 16 in the manner illustrated in FIGS. 6 and 7. With this arrangement rotation of the endless belt 66 by the rollers 64 propels the vehicles 14 through the station 16 at the rate of revolution of the belt 66. When the vehicle 14 has approached the platforms 58 and 60 for the boarding and departure of passengers, the braking mechanism 50 is actuated to bring the vehicle 14 to a stop within the waterway 12.

Figure 8:
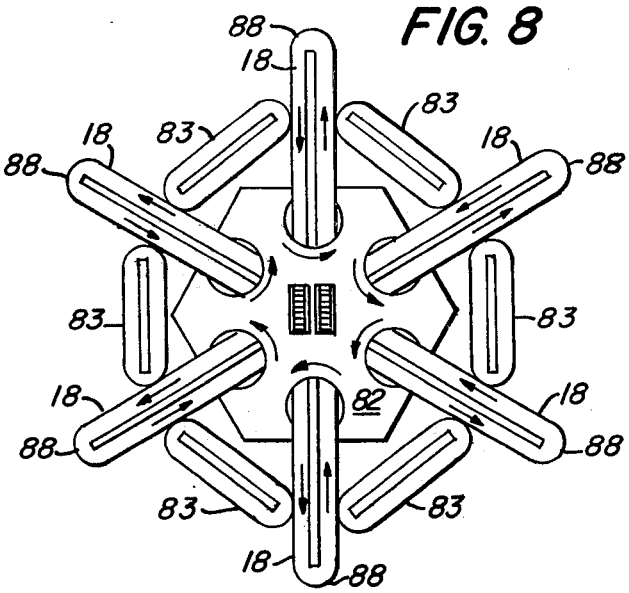
FIG. 8 is a schematic representation of a plurality of transit loops radiating outwardly from a main terminal for the transportation of passengers to and from the main terminal with trunk loops interconnecting the transit loops.

Another embodiment of the present invention is illustrated in FIG. 8 in which a plurality of endless transit loops 18 comprising the waterway 12 radiate outwardly in preselected directions from a main terminal 82. With this arrangement the continuous transit loops 18 provide continuous movement of the vehicles 14 in the divided waterway 12 to and from the main terminal 82. In addition the loops 18 may be interconnected by trunk lines 83 for providing transportation between stations of different loops 18. A plurality of substations (not shown) may be provided in each of the endless loops 18 for the boarding and departure of passengers at selected points in the endless loop 18. Each substation then would be inter-connected to provide transportation between substations or transportation between substations and the main terminal 82 and substations in the trunk lines 83.

Figure 9:
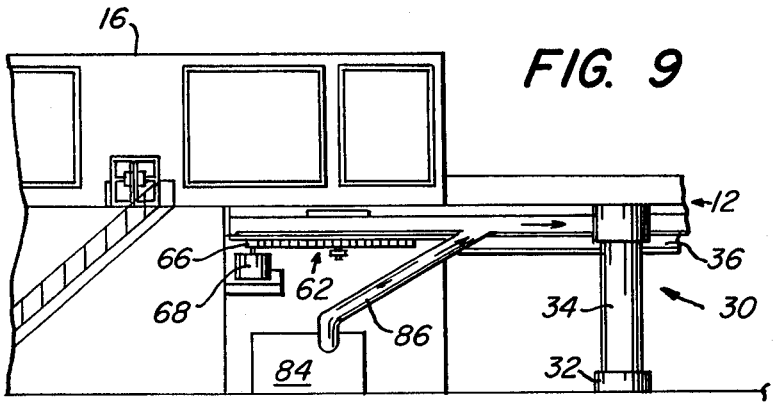
FIG. 9 is a fragmentary view in side elevation of the main terminal shown in FIG. 8, illustrating the pumping system for conducting fluid to the elevated waterway for propelling the vehicles in the waterway.

As illustrated in FIG. 8 the waterway 12 is divided to form a pair of parallel waterways for simultaneous movement of vehicles to and from the main terminal 82. The hydraulic system for generating continuous forward movement of water in each of the transit loops 18 is illustrated in FIG. 9. A pump 84 located at the main terminal generates continuous circulation of water in the transit loop 18 by connecting the pump 84 to the waterway 12 by feed conduit 86. To compensate for the reduced flow of fluid at the main station 82 or at the substations located in each transit loop 18 the powered endless conveyor 62 illustrated in detail in FIGS. 5, 6, and 7 described hereinbefore is operable to control the movement of the vehicles at the main terminal 82.

Figure 10:
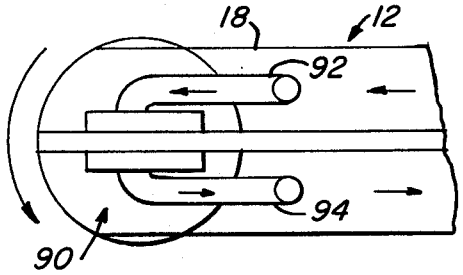
FIG. 10 is an enlarged top plan view of a schematically illustrated water pump provided at the end of each transit loop illustrated in FIG. 8 for circulating water through the endless transit loop.
Figure 11:
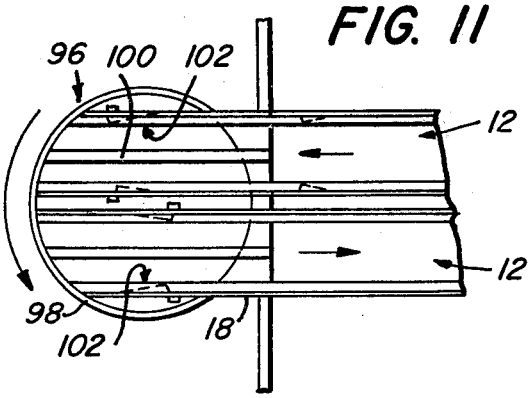
FIG. 11 is an enlarged fragmentary view of a vehicle turn-around for each transit loop as shown in FIG. 8, illustrating the direction of rotation of the turn-around to reverse the direction of travel of the vehicles in the waterway.
Figure 12:
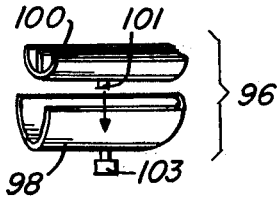
FIG. 12 is an exploded perspective view of the vehicle turn-around shown in FIG. 11, illustrating the manner in which a segment of the waterway is rotatably supported by a concave shaped disc shaped portion.
Figure 13A:
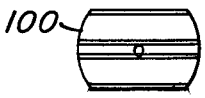
FIG. 13A is a fragmentary top plan view, illustrating the waterway segment that is rotatably supported by the concave disc portion illustrated in FIG. 12.
Figure 13B:
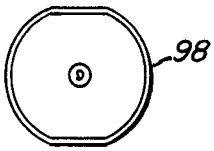
FIG. 13B is a fragmentary top plan view, illustrating the concave disc portion that rotatably supports the waterway segment illustrated in FIG. 12.

At the outermost point 88 of the transit loop, at which the vehicles are directed back to the main terminal 82, a suitable hydraulic system generally designated by the numeral 90 and illustrated in FIG. 10 is provided to maintain a continuous flow of water in the adjacent waterway 12. At the outermost point 88 of the loop 18, a water pump 90 receives fluid from conduit 92 and directs the fluid at a preselected rate of flow through conduit 94 in the opposite direction of flow to conduit 92. With this arrangement the vehicles 14 move at a preselected rate between the adjacent waterways at the outermost point 88 in the transit loop.

Once the vehicles have completed a run on a transit loop 18 and have returned to the main terminal 82 a rotatable mechanism generally designated by the numeral 96 and illustrated in FIGS. 9, 10–13 is provided for each transit loop at the terminal 82 for changing directions of the vehicles in the waterway 12. The mechanism 96 may also be located at intermediate points in a loop 18 for short round trips. The rotatable mechanism 96 concludes a concave disc portion 98 having open end portions and stationarily positioned at the end of each loop 18 and at selected points between the loop end 88 and the terminal 82. The concave disc portion 98 is non-rotatably mounted in a suitable fashion on the superstructure 30. A section 100 of the divided waterway 12 is positioned within the concave disc portion 98. The waterway section 100 is secured for rotation within the disc portion 98 by a shaft 101 drivingly connected to motor 103. With this arrangement as illustrated in FIG. 9 when a vehicle 14 has reached the main terminal 82 it is brought to a halt by the braking apparatus generally designated by the numeral 102 provided on the disc portion 98. Rotation of the waterway section 100 through an angle of 180° in the direction indicated by the arrow realigns the waterway section 100 with the divided waterway 12. The vehicle may then proceed having been turned around in the waterway 12 to once again complete a circuit on the continuous transit loop 18.

Figure 14:
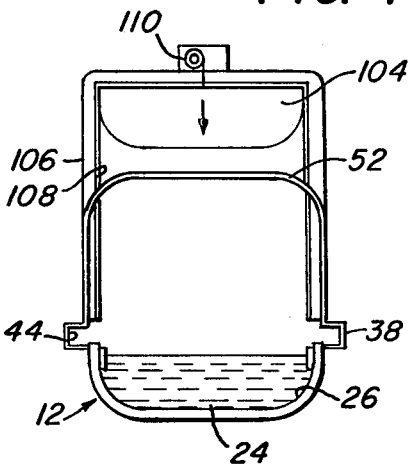
FIG. 14 is a view in side elevation of the enclosed waterway, illustrating a vertically movable emergency partition that is operable to slide through an opening in the enclosure to contact the bottom wall of the waterway to seal off a portion of the waterway.
Figure 15:
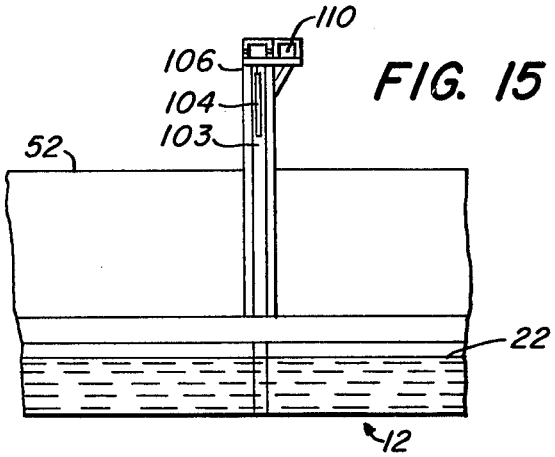
FIG. 15 is a view in side elevation of the slidable emergency partition illustrated in FIG. 14.

Further in accordance with the present invention as illustrated in FIGS. 14 and 15 there is provided a partition 104 that is vertically movable through the waterway enclosure 52 to engage the waterway bottom wall 24 and sidewalls 26 to seal off desired sections of the waterway 12. The partition or emergency door 104 as shown in FIG. 14 has a configuration which conforms substantially to the cross sectional configuration of the waterway 12. The partition 104 is vertically supported above the enclosure 52 by a frame 106 having guideways 108 for receiving the edge portions of the partition 104. With this arrangement the partition 104 is slidable vertically on the support frame 106. A suitable drive mechanism 110 is operable to raise and lower the partition 104 through opening 112 provided in the enclosure 52 and downwardly into engagement with the sidewalls and bottom wall of the waterway 12. By positioning the partitions 104 at selected intervals along the waterways 12 in the transit loop 18 sections of the transit loop 18 may be blocked off to provide access to the waterway 12 and prevent flow from the partitioned sections.

Figure 16:
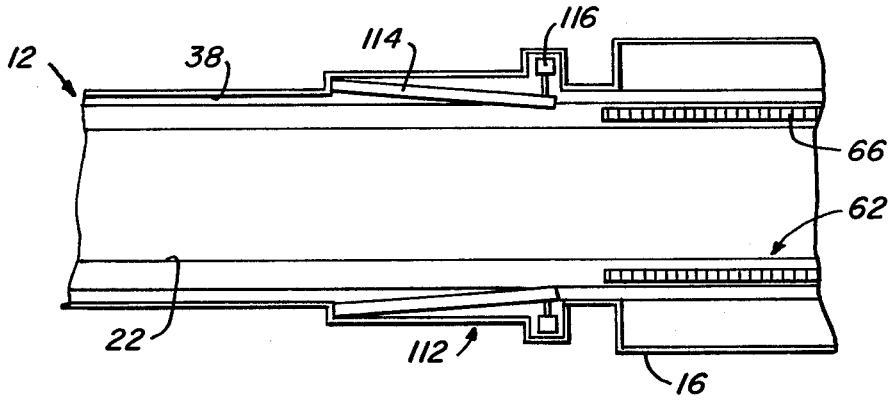
FIG. 16 is a top plan view of the braking apparatus provided on the waterway for slowing vehicles as they approach a station or a downward grade of the waterway.

In accordance with the present invention the transit system 10 may be provided with a braking mechanism generally designated by the numeral 112 and illustrated in FIGS. 7 and 16. The braking mechanisms 112 may be located at selected points along the waterway 12 and before and after the various stations 16 provided in the transit system for stopping the vehicles in the waterway and slowing the movement of the vehicles as they approach the station 16 from opposite directions. The braking mechanism 112 illustrated in FIGS. 7 and 16 includes a braking shoe or bar 114 that is pivotally connected at one end portion to the guide track 38 within the recess 40. The opposite end portion of the braking bars 114 are connected to an actuator device 116 (not shown in FIG. 7). Operation of the actuator device 116 urges the braking bars to pivot about their connection to the waterway guide track 38 so that the end portions of the bars 114 extend into the path of the vehicles to obstruct the movement of the vehicles through the waterway. It is preferred that the braking mechanisms 112 be located adjacent the powered endless conveyors 62 so that once the speed of the vehicles 14 in the waterway 12 has been reduced by the braking bars 114 the movement of the vehicles through the station 16 may be controlled by engagement of the vehicles with the powered endless conveyor 62 as explained and described hereinbefore.

Figure 17:
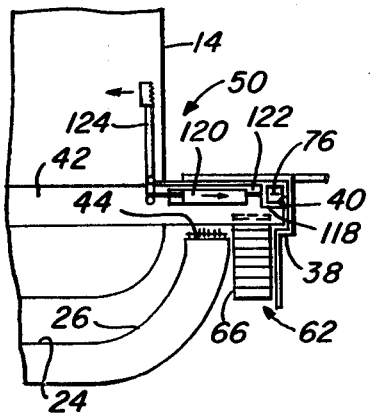
FIG. 17 is an enlarged fragmentary view in side elevation of another embodiment of the braking apparatus provided on each vehicle, illustrating an actuator for engaging the brake shoe with the waterway guide track for stopping the vehicle in the waterway.
Figure 18:
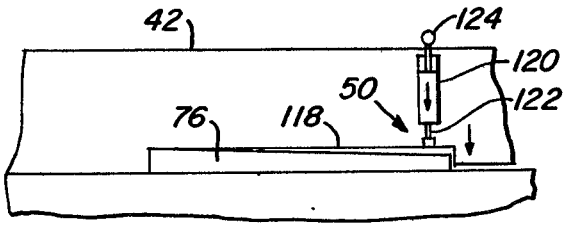
FIG. 18 is a top plan view of the braking apparatus shown in FIG. 17, illustrating the braking shoe pivotally connected to the vehicle and movable into engagement with the guide track.

The braking mechanism 50 as illustrated in FIGS. 17 and 18 is provided on each of the vehicles 14 and includes a brake shoe 76 that is pivotally connected at one end to the vehicle 14 within bumper recess 118 and is positioned in the recess 40 of guide track 38. The free end portion of the brake shoe 76 is secured to a piston cylinder assembly 120 by a piston rod 122 that extends outwardly from the cylinder 120. Actuation of the piston cylinder assembly 120 by hand lever 124 pivotally connected to assembly 120 extends and retracts piston rod 122 to move the brake shoe 76 into and out of frictional engagement with the guide track 38.

Movement of the hand lever 124 in the direction indicated by the arrow in FIG. 17 advances the piston within the assembly 120 to extend the piston rod 122 outwardly and urge the free end portion of the brake shoe 76 into frictional engagement with the guide track 38. In this manner the forward motion of the vehicle 14 in the waterway 12 is retarded, and accordingly the vehicle 14 may be brought to a halt. The braking arrangement illustrated in FIGS. 17 and 18 may be provided on both sides of the vehicle 14 to provide for uniform stopping of the vehicle within the waterway 12 to assure stability of the vehicles as it is brought to rest.

Figure 19:
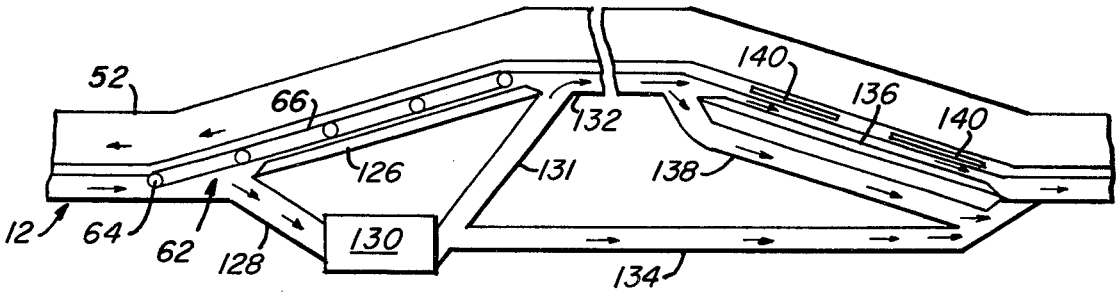
FIG. 19 is a schematic representation of a powered endless conveyor for propelling the vehicles up an elevated portion of the waterway, illustrating the hydraulic circuitry for conducting flow to and from the inclined portions of the waterway.
Figure 20:
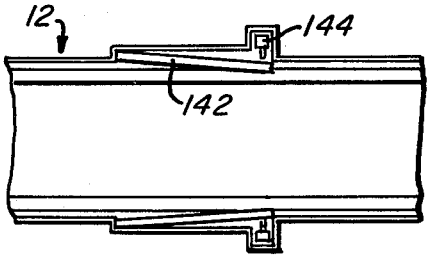
FIG. 20 is a fragmentary top plan view of the braking apparatus provided on the downward inclined portions of the waterway for slowing movement of vehicles.

Because of variations in the elevation of the terrain on which the transit system 10 of the present invention is located suitable means are provided for advancing the vehicles up and down an inclined portion of the waterway as illustrated in FIGS. 19 and 20. To advance the vehicles 14 up an inclined grade of the waterway 12, the powered endless conveyor system 62 is arranged to engage the vehicle in the manner hereinbefore described and move it up the incline 126 by rotation of the endless belt 66 on the rollers 64. Certain of the rollers 64 may be driven to rotate the belt 66 at a selected speed for advancing the vehicles 14 up the inclined slope 126. Flow of water is diverted from the inclined portion 126 of the waterway 12 by conduit 128 directing the flow into a water pump 130. The water pump 130 is connected by conduits 131 to the elevated portion 132 of the waterway 12 and to the lower portion of the waterway 12 by conduit 134. The pumps 130 are also operable to transfer flow to the trough of waterway 12 for transportation in the opposite direction.

The elevated portion 132 of the waterway 12 is connected by conduit 138 positioned substantially parallel to the downward grade 136 of the waterway 12. With this arrangement a continuous flow of water is diverted by the pump 130 from the incline 126 to the elevated portion 132 of the waterway 32 and therefrom through the downward grade portion 136 and to the lower portion of the waterway 12. To reduce the speed of the vehicles 14 down the grade 136 the brake mechanism 140 is provided on the waterway 12. The brake mechanism 140 illustrated in FIGS. 19 and 20 is similar to the brake mechanism 112 for slowing the vehicles as they approach the station 16.

The brake mechanism 140 includes a braking shoe 142 pivotally mounted at one end portion to the guide track 38 within the recess 40 and at the other end portion to an actuator device 144. Thus, operation of the actuator device 144 pivots the braking shoe 142 about its connection to the guide track 38 to urge the braking shoe 142 into the path of the approaching vehicle on the downward grade 136 and engage the body portion of the vehicles 14, specifically the bumper 42. In this manner the speed of the vehicle in the waterway down the grade 136 is retarded. Once the vehicles have traveled down the grade 136 to the lower portion of the waterway 12 illustrated in FIG. 19 the flow of water from the pump 130 through conduit 134 effects continuous forward movement of the vehicle 14 at a preselected speed in the waterway 12.

Figure 21:
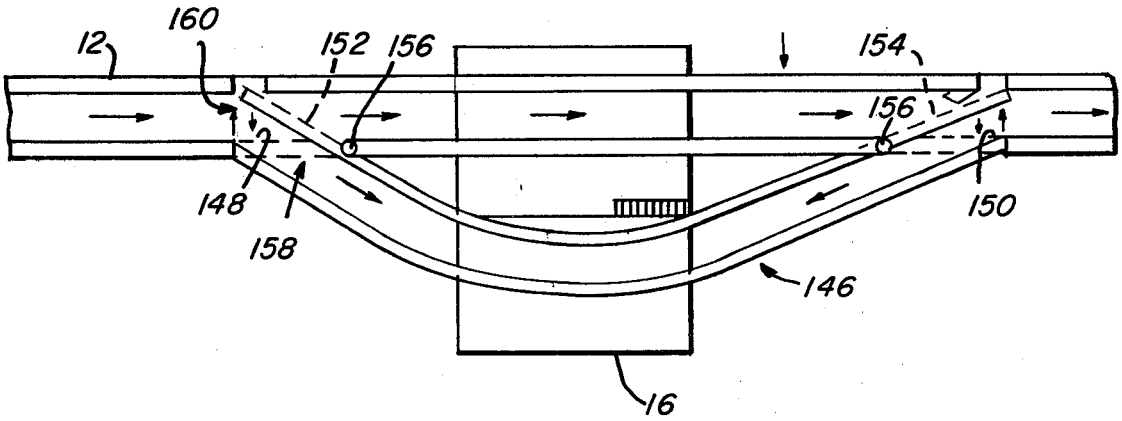
FIG. 21 is a top plan schematic view of a shunting track located in the station for diverting vehicle traffic to and from the main waterway at the station.

According to the practice of the present invention a shunting track generally designated by the numeral 146 and illustrated in FIG. 21 may be provided at each station 16 for diverting flow of vehicles approaching the station to and from that portion of the waterway 12 through the station 16 and back onto the waterway 12. The shunting track 146 includes an entrance 148 from the waterway 12 and an exit 150 to the waterway 12. Control gates 152 and 154 formed by pivotal sections of the guide track 38 are positioned in the entrance 148 and exit 150 respectively to prohibit access by a vehicle to the shunting track 146. Each of the control gates 152 and 154 are pivotal about a vertical axis 156 between a first portion 158 blocking access to the shunting track 146 and a second position 160 providing access to the shunting track 146.

When the gates 150 and 152 are swung outwardly into the waterway 12 about the vertical axis 156, the flow of water is diverted from the waterway 12 into the shunting track 146 and back onto the waterway on the other side of the station. Thus, the vehicles are prevented from passing through the station 16 and are diverted therearound in the shunting track 146. Accordingly, the gates 150 and 152 moving from the second position to the first position provide resumption of water flow and vehicle traffic through the station 16 on the waterway 12. By selectively opening and closing the gates 150 and 152 it is possible to either provide continuous unimpeded flow of vehicle traffic through the station 16 without slowing the flow at the station 16, as in the case of an express run, or to effect inserting, storing and removing vehicles from the main waterway 12.

According to the provisions of the patent statutes I have explained the principle, preferred construction and mode of operation of my invention and have illustrated and described what I now consider to represent its best embodiments. However, it should be understood that within the scope of the appended claims the invention may be practiced otherwise than is specifically illustrated and described.

I claim:

1. A rapid transit system comprising, a superstructure, an endless waterway supported by said superstructure, said endless waterway having a bottom wall and sidewalls extending upwardly therefrom to form a trough for the continuous forward flow of water therethrough, a plurality of vehicles for transporting passengers between selected locations on said waterway, said vehicles being bouyantly supported in said waterway, stabilizing means secured to said waterway for maintaining said bouyantly supported vehicles at a selected depth in said waterway, braking means provided on each of said vehicles for controlling the movement of said vehicles in said waterway, pump means for generating continuous forward movement of water in said waterway to forwardly propel said vehicles, a main terminal for passengers boarding and departure, a plurality of said waterways forming endless transit loops radiating in selected directions from said main terminal to provide transportation between a plurality of stations located along said waterway and said main terminal, rotatable means located at the end of each of said transit loops and at said main terminal for changing direction of said vehicles in said transit loops, a concave disc portion rigidly positioned at the end of each of said transit loops, at said main terminal and at selected points therebetween, and a section of said waterway positioned within each of said concave disc portions and rotatable relative thereto to facilitate change of direction of said vehicles within said waterway.

2. A rapid transit system as set forth in claim 1 which includes, a plurality of stations located at selected points on said endless waterway, boarding and departing platforms extending outwardly from each of said stations adjacent said waterway sidewalls, powered endless conveyor means positioned parallel to said waterway at each of said stations for controlling movement of said vehicles into, through and from said stations, and said braking means including a braking shoe connected to said waterway at each of said stations for frictionally engaging the body portion of said vehicles to bring said vehicles to a stop in said waterway.

3. A rapid transit system as set forth in claim 1 in which said powered endless conveyor means includes, a plurality of stations located at selected points on said endless waterway, a plurality of rollers rotatably mounted adjacent to and outboard of said waterway sidewalls, said rollers spaced at intervals at each of said stations and extending a preselected distance in opposite directions from said respective stations, an endless belt reeved around said rollers and arranged to frictionally engage the body portion of said vehicles, drive means for rotating certain of said rollers in a preselected direction to revolve said endless belt around said rollers and advance said vehicles at a controlled rate of speed through said stations to facilitate boarding and departure of passengers, and said endless belt having means for engaging the body portion of said vehicles in said waterway such that said vehicles are restrained from moving relative to the surface of said endless belt.

4. A rapid transit system as set forth in claim 1 which includes, interconnecting transit loops joining together said endless transit loops for transporting passengers therebetween.

5. A rapid transit system as set forth in claim 1 in which said stabilizing means includes, a guide track secured to said sidewalls of said waterway, said guide track having parallel recesses positioned at a selected height above said bottom wall of said waterway, a plurality of rollers secured to said guide track within said track recesses, and said rollers being arranged to rotatably engage each of said vehicles to stabilize said vehicles moving in said waterway.

6. A rapid transit system as set forth in claim 1 in which said braking means includes, a brake shoe pivotally connected at one end to each of said vehicles, power means positioned on each of said vehicles and connected to the opposite end of said brake shoe for moving said brake shoe into and out of frictional engagement with said stabilizing means to effect braking of the vehicles in said waterway, and means provided on said vehicles and connected to said power means for actuating said power means.

7. A rapid transit system comprising, a superstructure, an endless waterway supported by said superstructure, said endless waterway having a bottom wall and sidewalls extending upwardly therefrom to form a trough for the continuous forward flow of water therethrough, a plurality of vehicles for transporting passengers between selected locations on said waterway, said vehicles being bouyantly supported in said waterway, stabilizing means secured to said waterway for maintaining said bouyantly supported vehicles at a selected depth in said waterway, braking means provided on each of said vehicles for controlling the movement of said vehicles in said waterway, pump means for generating continuous forward movement of water in said waterway to forwardly propel said vehicles, a transparent enclosure extending upwardly from said waterway to confine said vehicles within said waterway, means extending from said transparent enclosure for supplying electrical power to each of said vehicles in said waterway, partition means slidably mounted above said transparent enclosure for vertical movement therethrough into contact with said waterway sidewalls and bottom wall for interrupting the flow of water in said waterway, and said partition means being located at selected intervals along said waterway.

8. A rapid transit system as set forth in claim 7 in which said partition means includes, a frame extending upwardly from said waterway sidewalls through said transparent enclosure, said frame having a guideway vertically aligned with said waterway sidewalls, a partition having the configuration of said waterway and slidably mounted within said frame guideway, and means for raising and lowering said partition on said frame through said enclosure into abutting relation with said waterway sidewalls and bottom wall to obstruct flow of water through said waterways.

* * * * *